US006408782B1

(12) United States Patent
Mitchell

(10) Patent No.: US 6,408,782 B1
(45) Date of Patent: Jun. 25, 2002

(54) DAMAGED BOAT FLOATATION SYSTEM

(76) Inventor: Carl P. Mitchell, 1580 W. 8th St. Apt. 165, Upland, CA (US) 91786

( * ) Notice: Subject to any disclaimer, the term of this patent is extended or adjusted under 35 U.S.C. 154(b) by 0 days.

(21) Appl. No.: 09/810,065

(22) Filed: Mar. 16, 2001

(51) Int. Cl.[7] ..... B63B 43/02
(52) U.S. Cl. ..... 114/360; 114/44
(58) Field of Search ..... 441/40–42, 43; 114/345, 44, 45, 360, 263, 54, 68, 123

(56) References Cited

U.S. PATENT DOCUMENTS 2,826,337 A * 3/1958 Ford et al. ..... 114/345
3,797,435 A 3/1974 Dunson
D293,778 S 1/1988 Curbow
4,817,555 A 4/1989 Meinen
4,864,961 A 9/1989 Slonski
4,996,936 A 3/1991 Brundritt
5,357,888 A 10/1994 Insinna
5,411,425 A * 5/1995 Rinker ..... 441/130
5,860,379 A * 1/1999 Moody ..... 114/54
6,080,027 A * 6/2000 Rodemann ..... 441/42

* cited by examiner

*Primary Examiner*—Ed Swinehart

(57) ABSTRACT

A damaged boat floatation system for providing floatation to damaged boats. The damaged boat floatation system includes a floatation assembly including air inflatable tubular members being attached end-to-end to form an endless tube being adapted to fit about sides of a boat; and also includes a compressed air container for filling the endless tube with compressed air; and further includes a carrying case for carrying the floatation assembly and the compress air container.

18 Claims, 2 Drawing Sheets

DAMAGED BOAT FLOATATION SYSTEM

BACKGROUND OF THE INVENTION

1. Field of the Invention

The present invention relates to a boat lifesaving system and more particularly pertains to a new damaged boat floatation system for providing floatation to damaged boats.

2. Description of the Prior Art

The use of a boat lifesaving system is known in the prior art. More specifically, a boat lifesaving system heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,357,888; U.S. Pat. No. 4,996,936; U.S. Pat. No. 4,817,555; U.S. Pat. No. 4,864,961; U.S. Pat. No. 3,797,435; and U.S. Pat. No. Des. 293,778.

While these devices fulfill their respective, particular objectives and requirements, the aforementioned patents do not disclose a new damaged boat floatation system. The inventive device includes a floatation assembly including air inflatable tubular members being attached end-to-end to form an endless tube being adapted to fit about sides of a boat; and also includes a compressed air container for filling the endless tube with compressed air; and further includes a carrying case for carrying the floatation assembly and the compress air container.

In these respects, the damaged boat floatation system according to the present invention substantially departs from the conventional concepts and designs of the prior art, and in so doing provides an apparatus primarily developed for the purpose of providing floatation to damaged boats.

SUMMARY OF THE INVENTION

In view of the foregoing disadvantages inherent in the known types of boat lifesaving system now present in the prior art, the present invention provides a new damaged boat floatation system construction wherein the same can be utilized for providing floatation to damaged boats.

The general purpose of the present invention, which will be described subsequently in greater detail, is to provide a new damaged boat floatation system which has many of the advantages of the boat lifesaving system mentioned heretofore and many novel features that result in a new damaged boat floatation system which is not anticipated, rendered obvious, suggested, or even implied by any of the prior art boat lifesaving system, either alone or in any combination thereof.

To attain this, the present invention generally comprises a floatation assembly including air inflatable tubular members being attached end-to-end to form an endless tube being adapted to fit about sides of a boat; and also includes a compressed air container for filling the endless tube with compressed air; and further includes a carrying case for carrying the floatation assembly and the compress air container.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new damaged boat floatation system which has many of the advantages of the boat lifesaving system mentioned heretofore and many novel features that result in a new damaged boat floatation system which is not anticipated, rendered obvious, suggested, or even implied by any of the prior art boat lifesaving system, either alone or in any combination thereof.

It is another object of the present invention to provide a new damaged boat floatation system which may be easily and efficiently manufactured and marketed.

It is a further object of the present invention to provide a new damaged boat floatation system which is of a durable and reliable construction.

An even further object of the present invention is to provide a new damaged boat floatation system which is susceptible of a low cost of manufacture with regard to both materials and labor, and which accordingly is then susceptible of low prices of sale to the consuming public, thereby making such damaged boat floatation system economically available to the buying public.

Still yet another object of the present invention is to provide a new damaged boat floatation system which provides in the apparatuses and methods of the prior art some of the advantages thereof, while simultaneously overcoming some of the disadvantages normally associated therewith.

Still another object of the present invention is to provide a new damaged boat floatation system for providing floatation to damaged boats.

Yet another object of the present invention is to provide a new damaged boat floatation system which includes a floatation assembly including air inflatable tubular members being attached end-to-end to form an endless tube being adapted to fit about sides of a boat; and also includes a compressed air container for filling the endless tube with compressed air; and further includes a carrying case for carrying the floatation assembly and the compress air container.

Still yet another object of the present invention is to provide a new damaged boat floatation system that is easy and convenient to use.

Even still another object of the present invention is to provide a new damaged boat floatation system that creates buoyancy for a boat which may become damaged while being used.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
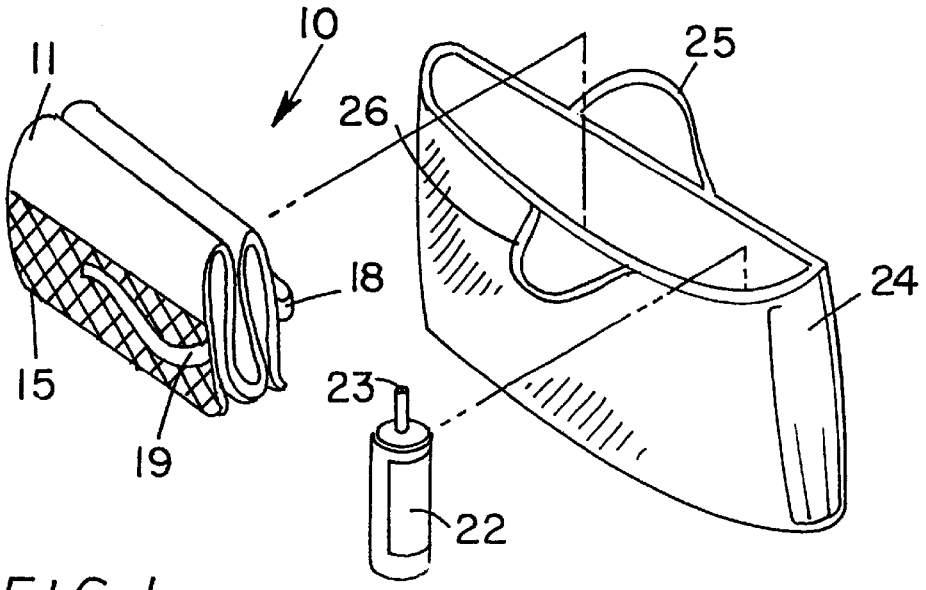
FIG. 1 is an exploded perspective view of a new damaged boat floatation system according to the present invention.
Figure 2:
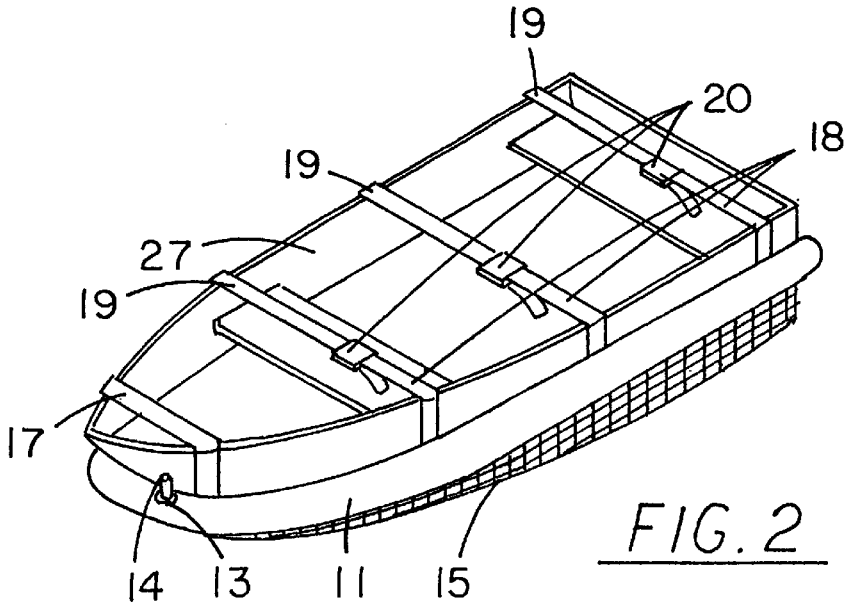
FIG. 2 is a perspective view of the present invention being used.
Figure 3:
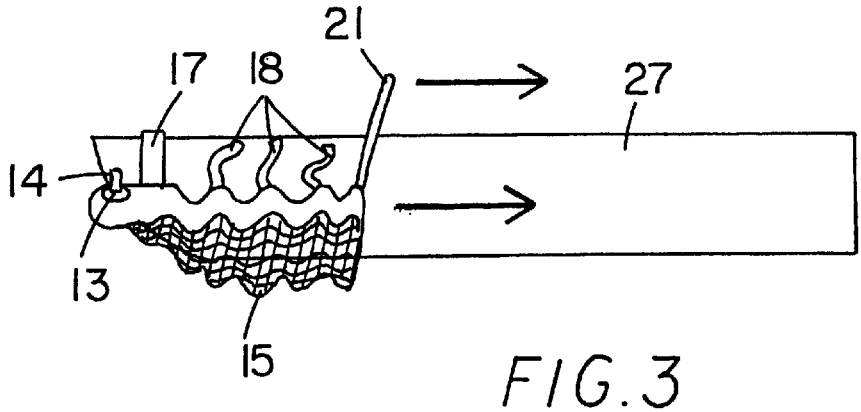
FIG. 3 is a side elevational view of the present invention being mounted to a boat.
Figure 4:
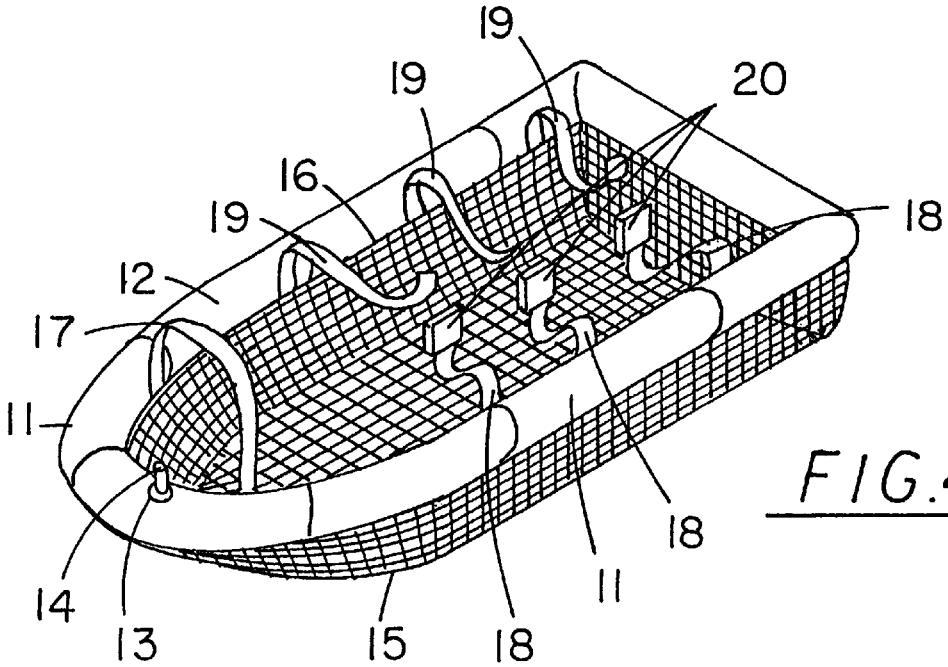
FIG. 4 is a perspective view of the floatation assembly of the present invention.

With reference now to the drawings, and in particular to FIGS. 1 through 4 thereof, a new damaged boat floatation system embodying the principles and concepts of the present invention and generally designated by the reference numeral 10 will be described.

As best illustrated in FIGS. 1 through 4, the damaged boat floatation system 10 generally comprises a floatation assembly including air inflatable tubular members 11 being conventionally attached end-to-end to form an endless tube being adapted to fit about sides of a boat 27. The floatation assembly further includes a valve member 13 being conventionally disposed through a side wall 12 of the endless tube and through which compressed air enters and exits the endless tube, and also includes a net member 15 being securely and conventionally attached to and along the endless tube and being adapted to be disposed beneath the boat 27, and further includes a plurality of fastening members 17–20 being securely and conventionally attached to the net member 15 and being adapted to extend upon a top of the boat 27 to securely fasten the endless tube and the net member 15 to the boat 27. The valve member 13 includes a tubular stem 14 extending from the endless tube. The net member 15 includes an outer edge 16 which is securely and conventionally attached to and along an inner side of the endless tube and which is disposed between the inflatable tubular members 11. The fastening members 17–20 include a plurality of strap members 17–19 having ends being securely and conventionally attached to the net member 15. The strap members 17–20 include pairs of first and second strap members 18,19. The fastening members 17–20 also include a plurality of buckles 20 being conventionally attached to outer ends of the first strap members 18 and being attachable to the second strap members 19 for fastening the pairs of strap members 18,19 about the top of the boat 27. The floatation assembly also includes a towing member 21 being conventionally attached to the net member 15 and being adapted to move the tubular members 11 and the net member 15 along and under the boat 27. The towing member 21 is an elongate flexible member having ends being conventionally attached to the net member 15.

A compressed air container 22 for filling the endless tube with compressed air is generally a compressed air canister having a conduit 23 which is adapted to attach to valve member 13. A carrying case 24 for carrying the floatation assembly and the compress air container 22 includes handle members 25,26 being securely and conventionally attached to exteriors of side walls thereof.

In use, the user unfolds the tubular members 11 and the net member 15 and uses the towing member 21 to pull the tubular members 11 and the net member 15 along and under the boat 27. The user then attaches the compressed air container 22 to the valve member 13 to fill the tubular members 11 with air. The user then fastens the first and second strap members 18,19 together using the buckles 20 to secure the tubular members 11 and the net member about the boat 27.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A damaged boat floatation system comprising:

a floatation assembly including air inflatable tubular members being attached end-to-end to form an endless tube being adapted to fit about sides of a boat;

a compressed air container for filling said endless tube with compressed air; and a net member for disposing below the boat, said net member being attached to and along said endless tube.

2. A damaged boat floatation system as described in claim 1, wherein said floatation assembly further includes a valve member being disposed through a side wall of said endless tube and through which compressed air enters and exits said endless tube.

3. A damaged boat floatation system as described in claim 1, wherein said floatation assembly includes a plurality of fastening members attached to said net member and being adapted to extend upon a top of the boat to securely fasten said endless tube and said net member to the boat.

4. A damaged boat floatation system as described in claim 2, wherein said valve member includes a tubular stem extending from said endless tube.

5. A damaged boat floatation system as described in claim 1, wherein said net member includes an outer edge which is attached to and along an inner side of said endless tube and which is disposed between said inflatable tubular members.

6. A damaged boat floatation system as described in claim 3, wherein said fastening members include a plurality of strap members having ends attached to said net member, said strap members including pairs of first and second strap members, said fastening members also including a plurality of buckles being attached to outer ends of said first strap members and being attachable to said second strap members for fastening said pairs of strap members about the top of the boat.

7. A damaged boat floatation system as described in claim 1, wherein said floatation assembly also includes a towing member being attached to said net member and being adapted to move said tubular members and said net member along and under the boat, said towing member being an elongate flexible member having ends being attached to said net member.

8. A damaged boat floatation system as described in claim 2, wherein said compressed air container comprises a compressed air canister having a conduit which is adapted to attach to valve member.

9. A damaged boat floatation system as described in claim 1, additionally comprising a carrying case for carrying said floatation assembly and said compressed air container.

10. A damaged boat floatation system as described in claim 9, wherein said carrying case includes handle members being attached to exteriors of side walls thereof.

11. A damaged boat floatation system comprising:

a floatation assembly including air inflatable tubular members being attached end-to-end to form an endless tube being adapted to fit about sides of a boat;

a compressed air container for filling said endless tube with compressed air; and a carrying case for carrying said floatation assembly and said compress air container;

wherein said floatation assembly further includes a valve member being disposed through a side wall of said endless tube and through which compressed air enters and exits said endless tube, and also includes a net member being securely attached to and along said endless tube and being adapted to be disposed beneath the boat, and further includes a plurality of fastening members being securely attached to said net member and being adapted to extend upon a top of the boat to securely fasten said endless tube and said net member to the boat.

12. A damaged boat floatation system as described in claim 11, wherein said valve member includes a tubular stem extending from said endless tube.

13. A damaged boat floatation system as described in claim 11, wherein said net member includes an outer edge which is securely attached to and along an inner side of said endless tube and which is disposed between said inflatable tubular members.

14. A damaged boat floatation system as described in claim 11, wherein said fastening members include a plurality of strap members having ends securely attached to said net member, said strap members including pairs of first and second strap members, said fastening members also including a plurality of buckles being attached to outer ends of said first strap members and being attachable to said second strap members for fastening said pairs of strap members about the top of the boat.

15. A damaged boat floatation system as described in claim 11, wherein said floatation assembly also includes a towing member being attached to said net member and being adapted to move said tubular members and said net member along and under the boat, said towing member being an elongate flexible member having ends being attached to said net member.

16. A damaged boat floatation system as described in claim 11, wherein said compressed air container is generally a compressed air canister having a conduit which is adapted to attach to valve member.

17. A damaged boat floatation system as described in claim 11, wherein said carrying case includes handle members being securely attached to exteriors of side walls thereof.

18. A damaged boat floatation system comprising:

a floatation assembly including air inflatable tubular members being attached end-to-end to form an endless tube being adapted to fit about sides of a boat, said floatation assembly further including a valve member being disposed through a side wall of said endless tube and through which compressed air enters and exits said endless tube, and also including a net member being securely attached to and along said endless tube and being adapted to be disposed beneath the boat, and further including a plurality of fastening members being securely attached to said net member and being adapted to extend upon a top of the boat to securely fasten said endless tube and said net member to the boat, said valve member including a tubular stem extending from said endless tube, said net member including an outer edge which is securely attached to and along an inner side of said endless tube and which is disposed between said inflatable tubular members, said fastening members including a plurality of strap members having ends securely attached to said net member, said strap members including pairs of first and second strap members, said fastening members also including a plurality of buckles being attached to outer ends of said first strap members and being attachable to said second strap members for fastening said pairs of strap members about the top of the boat, said floatation assembly also including a towing member being attached to said net member and being adapted to move said tubular members and said net member along and under the boat, said towing member being an elongate flexible member having ends being attached to said net member;

a compressed air container for filling said endless tube with compressed air, said compressed air container being generally a compressed air canister having a conduit which is adapted to attach to valve member; and a carrying case for carrying said floatation assembly and said compress air container, said carrying case including handle members being securely attached to exteriors of side walls thereof.

* * * * *